US007921998B2

(12) United States Patent
Schenker

(10) Patent No.: US 7,921,998 B2
(45) Date of Patent: Apr. 12, 2011

(54) FILE ORGANIZER WITH DIVIDER BAR

(75) Inventor: David A. Schenker, Cedarburg, WI (US)

(73) Assignee: Innovative Storage Designs, Inc., Mequon, WI (US)

( * ) Notice: Subject to any disclaimer, the term of this patent is extended or adjusted under 35 U.S.C. 154(b) by 180 days.

(21) Appl. No.: 12/031,418

(22) Filed: Feb. 14, 2008

(65) Prior Publication Data

US 2009/0206045 A1 Aug. 20, 2009

(51) Int. Cl.
*B65D 85/00* (2006.01)

(52) U.S. Cl. ..... 206/425; 220/543; 220/549

(58) Field of Classification Search ..... 40/359, 40/641; 312/184, 183, 185, 193, 193.4; 220/532–550; 211/45, 46, 184, 59.4; 206/561, 206/449, 555, 556

See application file for complete search history.

(56) References Cited

U.S. PATENT DOCUMENTS

| | | | | | |
|---|---|---|---|---|---|
| 3,358,692 | A * | 12/1967 | Proulx | ..... | 220/529 |
| 3,999,819 | A * | 12/1976 | Schreyer | ..... | 312/184 |
| 5,052,646 | A * | 10/1991 | Hawes et al. | ..... | 248/214 |
| 5,190,152 | A * | 3/1993 | Smith et al. | ..... | 206/425 |
| 6,626,602 | B1 * | 9/2003 | Yuen | ..... | 402/73 |
| 2004/0035736 | A1 * | 2/2004 | Peleman | ..... | 206/425 |
| 2006/0151585 | A1 * | 7/2006 | Misjak | ..... | 229/120.24 |

* cited by examiner

*Primary Examiner* — J. Gregory Pickett
*Assistant Examiner* — Rishi Verma
(74) *Attorney, Agent, or Firm* — Andrus, Sceales, Starke & Sawall, LLP

(57) ABSTRACT

A file divider is provided for dividing a series of file folders having hanging rods with opposed ends slidably supported for movement on a file support edge of a file organizer. The file divider includes a body having opposed ends slidably supported for movement on the file support edge between a pair of file folders. The opposed ends have fingers projecting therefrom that are engageable with certain of the hanging rods of the file folders to maintain the stability of the divider bar when the file folders and the file divider bar are slidably moved on the file support edge.

15 Claims, 3 Drawing Sheets

FILE ORGANIZER WITH DIVIDER BAR

FIELD OF THE INVENTION

The present invention relates to a file organizer for hanging file folders. More specifically, the invention relates to a file organizer that includes a file divider that can be freely positioned along with the file folders to divide the file folders within an open storage cavity of the file organizer.

BACKGROUND OF THE INVENTION

Presently, storage containers are known that are designed to allow a series of hanging file folders to be supported along a file support edge within a container body, such as a file box or a file drawer. The storage container may or may not include a lid to enclose the container to prevent dirt, debris and moisture from entering into the storage container and damaging the material within the file folders. Some storage containers may also include file dividers supported on the file support edge that label sections of the storage container and help create file compartments for the hanging file folders.

In the normal use of storage containers having file folders, problems may occur in the manipulation of the file folders within the storage body which cause the file divider to tip and disengage from the file support edge. Therefore, a need exists for a file organizer provided with a file divider that can be freely positioned in a stable manner along with the file folders within the storage container to define compartments for the file folders.

SUMMARY OF THE INVENTION

The present invention relates to a file divider for dividing a series of file folders having hanging rods with opposed ends slidably supported for movement on a file support edge of a file organizer. The file divider includes a body having opposed ends slidably supported for movement on the file support edge between a pair of file folders. The opposed ends of the file divider have fingers projecting therefrom that are engageable with certain of the hanging rods of the file folders when the file folders and the file divider are slidably moved on the file support edge.

The fingers extend forwardly and rearwardly from the opposed ends of the file divider. The fingers are spaced below the opposed ends of the hanging rods of the file folders when the file folders and the file divider are stationary. At least one display tab rises from an uppermost surface of the file divider.

In another aspect of the invention, a file organizer includes a storage body having an outer wall, a file support edge and a bottom wall joined to the outer wall to define an open storage cavity. One or more file folders for holding various objects are positionable within the open storage cavity, and has opposed ends slidably supported for unrestricted movement on the file support edge. At least one file divider is positionable within the open storage cavity adjacent the file folders. The file divider has opposed ends slidably supported for unrestricted movement on the file support edge and stabilizing means engageable with one or more of the file folders for maintaining engagement of the file divider on the file support edge upon slidable movement together of the file folders and the file divider.

A U-shaped channel is joined to the outer wall of the file organizer and includes a base wall, an outer wall rising generally perpendicularly to the base wall and an inner side wall that rises generally perpendicular from the base wall and lies parallel to the outer side wall. The inner side wall has a top edge defining the file support edge. The file divider is a bar having a top edge, a bottom edge, a front face, and a rear face, the top edge having at least one display tab extending upwardly therefrom. The opposed end portions of the file divider have ears that extend into a receiving cavity formed between the inner and outer side walls. The stabilizing means is located on the opposed ends of the file divider. The stabilizing means is formed by fingers projecting from the file divider. A lowermost surface of the file divider lies above the base wall when the opposed ends thereof are supported on the file support edge.

In yet another embodiment of the invention, a file organizer has an outer wall joined to a bottom wall for defining an open storage cavity. The outer wall defines a file support edge for supporting opposed ends of a plurality of freely slidable file folders extending across a width of the file organizer for holding the various objects. The invention is improved by a file divider bar extending across the width of the file organizer between a pair of adjacently disposed file folders. The file divider bar has opposed ends supported for unrestricted movement upon the file support edge. The opposed ends are provided with stabilizing fingers engageable with certain of the file folders for maintaining the stability of the file divider bar as the file folders and the file divider bar are moved back and forth in the file organizer.

The file divider bar includes a top edge provided with a pair of display tabs, a bottom edge, a front face and a rear face. The fingers project forwardly and perpendicularly beyond the front face, and rearwardly and perpendicularly beyond the rear face. The file folders each include front and rear panels joined at lower ends. Each of the front and rear panels have sleeves for receiving hanging rods formed with the opposed ends that are supported on the file support edge. The fingers are engageable with the opposed ends of certain hanging rods when the file folders and the file divider bar are moved together. The fingers lie outside lateral edges of the panels, and are normally spaced below the hanging rods when the file folders and the file divider bar are stationary. The file divider bar has a length which is greater than a length of the hanging rods, a width and a height which is less than the width.

DETAILED DESCRIPTION OF THE DRAWINGS

The drawings illustrate the best mode presently contemplated for carrying out the invention.

DETAILED DESCRIPTION OF THE INVENTION

Figure 1:
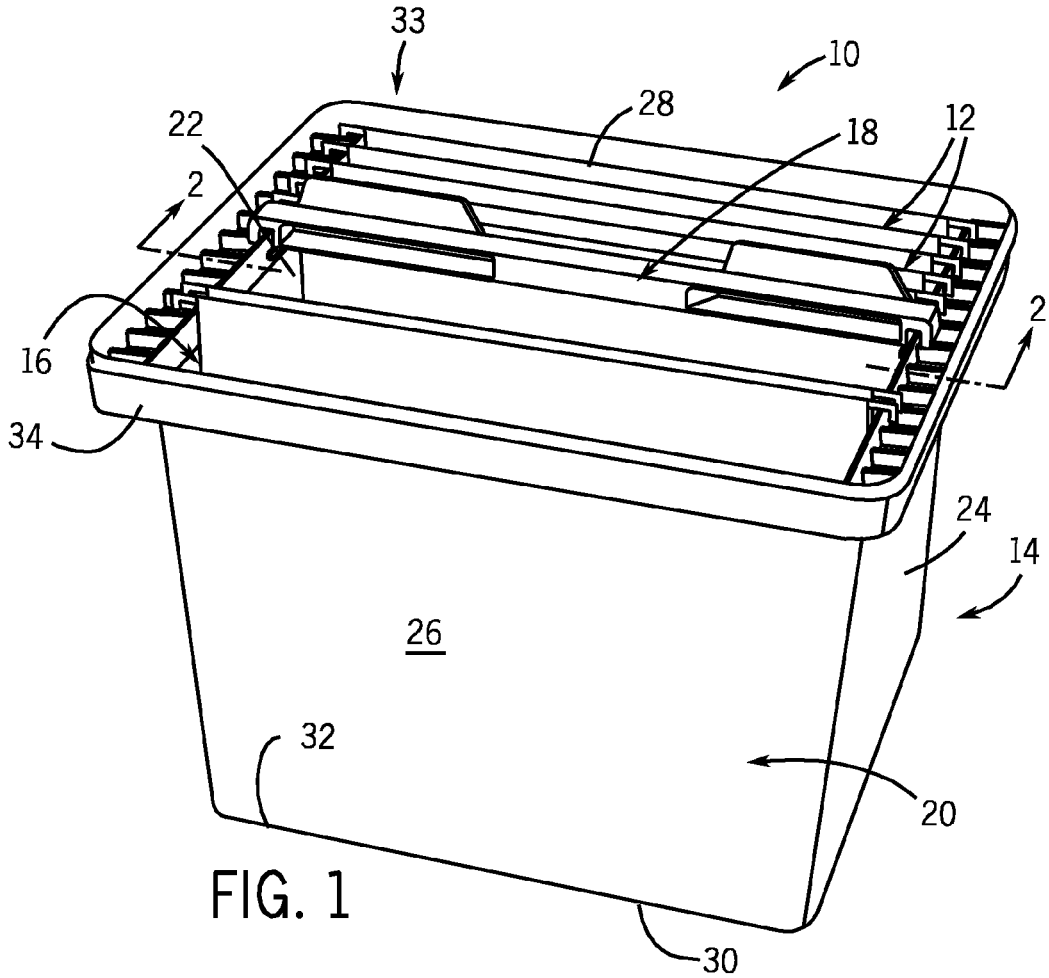
FIG. 1 is a perspective view illustrating a file organizer with a series of hanging file folders and a file divider bar.

FIG. 1 illustrates a file organizer 10 that can be used to hold a file folder arrangement or a series of slidable hanging file folders 12 for storage of papers, records and other information. The file organizer 10 has a storage body 14 for defining an open storage cavity 16 which is typically rectangular in cross section. The file organizer 10 includes a slidably adjustable file divider 18 for separating and categorizing the file folders 12 within the storage cavity 16.

The storage body 14 is provided with an outer peripheral wall 20 that includes a pair of opposed side walls 22, 24, and a pair of opposed end walls 26, 28 that serve as the respective front and rear walls of the storage body 14. The outer peripheral wall 20 is joined to the edge of a bottom wall 30 which generally defines the base of the storage body 14.

The outer peripheral wall 20 extends from a lower end 32 to an upper end 33 that defines a generally U-shaped peripheral channel 34. As seen best in FIG. 4, the channel 34 includes a base wall 36 that lies perpendicular to the outer peripheral wall 20, an outer side wall 38 that rises generally perpendicular to the base wall 36 and an inner side wall 40 that rises perpendicular from the base wall 36 and lies parallel to the outer side wall 38. The channel 34 is reinforced by a series of spaced apart upstanding tabs 42 that extend along the entire length of each of the side walls 22, 24, and interconnect base wall 36, outer side wall 38 and inner side wall 40 together. A top edge 44 of inner side wall 40 lies beneath a top edge 46 of outer side wall 38 and defines a file support edge for the file folder 12 and the file divider 18.

Figure 5:
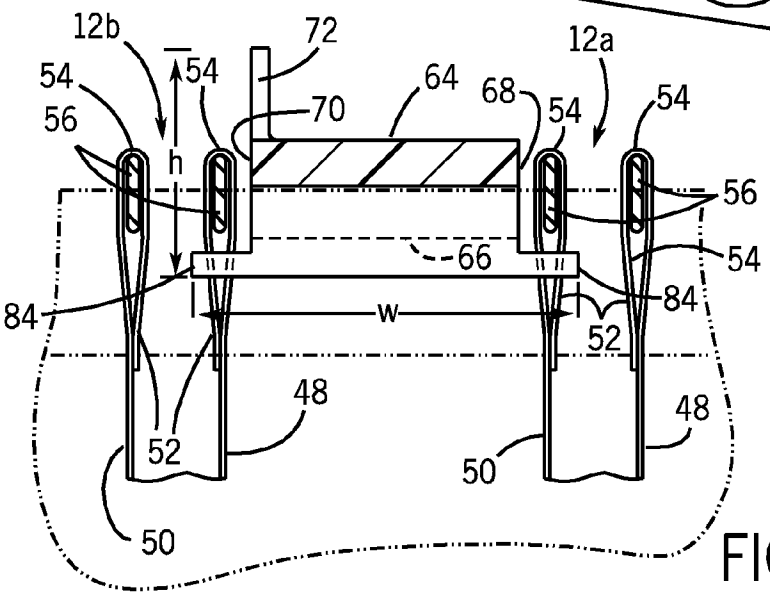
FIG. 5 is a sectional view taken on line 5-5 of FIG. 4.
Figure 4:
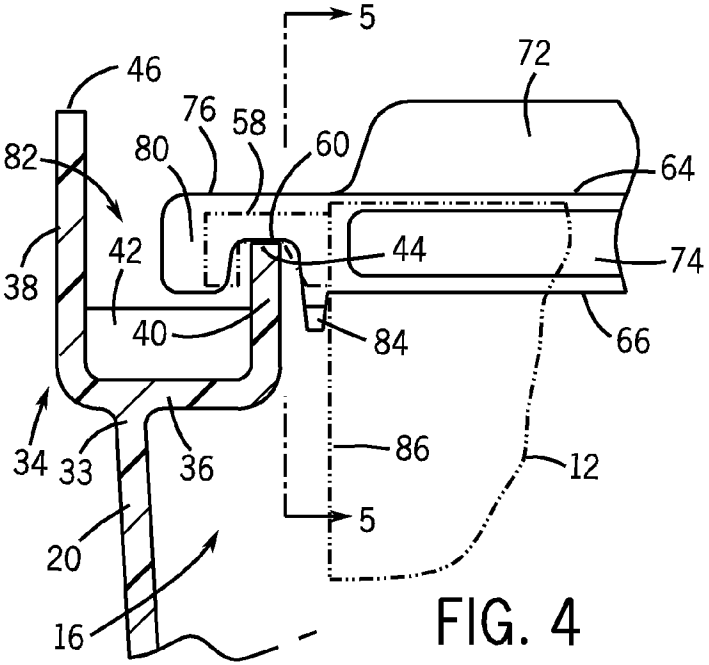
FIG. 4 is an enlarged view taken on line 4-4 of FIG. 2.

As is well known, each hanging file folder 12 provides an expandable pocket for receiving and holding various information and objects within the file organizer 10. Referring to FIGS. 4 and 5, each file folder 12*a*, 12*b*, includes a front panel 48 and a rear panel 50 connected at their bottom ends. Top edges 52 of the front and rear panels 48, 50 are folded over and secured to form sleeves 54 that slidably receive hanging rods 56. The rods 56 extend across the width of the storage cavity 16 and have opposed notched ends 58 formed with walls 60 having upper portions that rest upon the file support edge 44. In this manner, the storage body 14 is able to support a series of hanging file folders 12 such that their bottom edges are suspended slightly above the bottom wall 30 of the file organizer 10. As seen in FIG. 4, the lowermost portions of the hanging rods 56 lie above the tabs 42 such that the file folders 12 can freely slide along the length of the file support edge 44.

The file divider 18 is freely positionable within the open storage cavity 16 to divide the file folders 12 in the storage body 14. As illustrated in FIG. 1, the file divider 18 extends across the width of the storage cavity 16, and is slidably positioned along the length of each of the side walls 22, 24 to separate the file folders 12. Although one file divider 18 is shown in the figures, it should be understood that multiple file dividers 18 may be utilized as desired.

Figure 2:
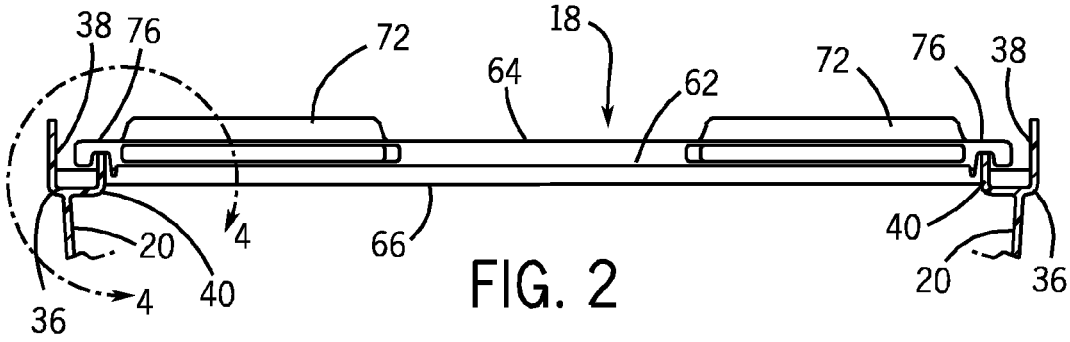
FIG. 2 is a sectional view taken on line 2-2 of FIG. 1.
Figure 3:
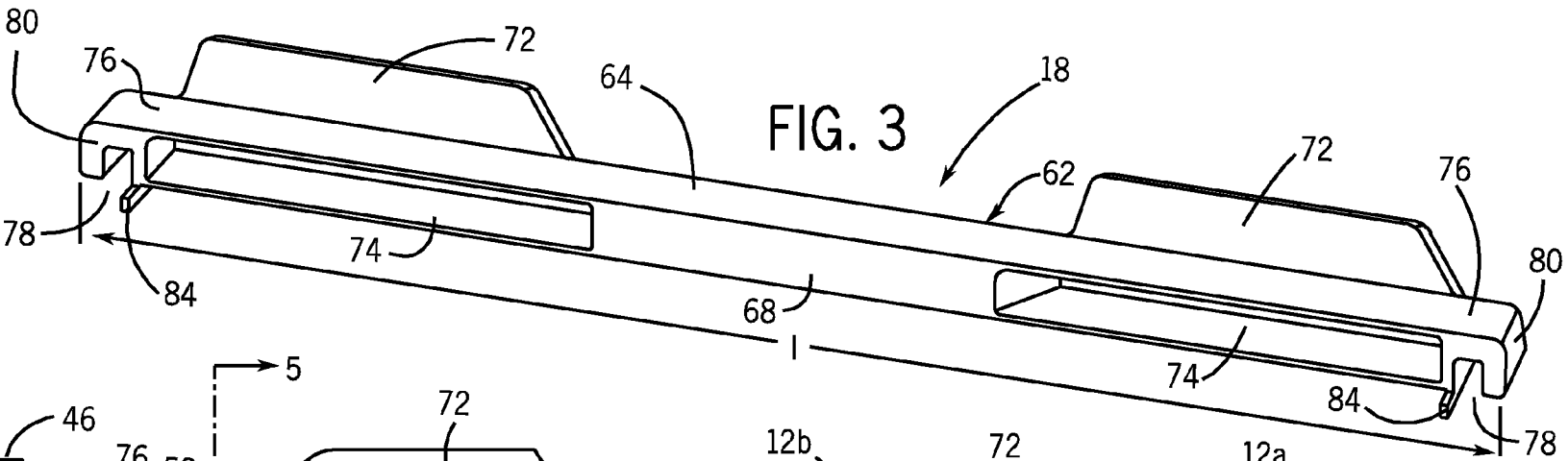
FIG. 3 is an enlarged perspective view of the file divider bar shown in FIG. 1.

Referring now to FIGS. 2, 3 and 5, the file divider 18 preferably takes the form of an elongated bar with a main body portion 62 having a top edge 64, a bottom edge 66, a front face 68 and a rear face 70. Top edge 64 is provided rearwardly thereof with a pair of spaced apart display tabs 72 that rise upwardly. Each of the display tabs 72 is sized to permit a label to be applied to the file divider bar 18 to collectively describe a file folder compartment. The front face 68 has two elongated recesses 74 that reduce the amount of material used to form the file divider bar 18, thereby lessening the weight and cost of the file divider bar 18.

The file divider bar 18 includes opposed cut out end portions 76 formed with support cavities 78 having upper portions that rest upon the file support edge 44 like the ends 58 of the file folders 12. The opposed end portions 76 carry ears 80 that extend into a receiving cavity 82 between outer and inner side walls 38, 40, respectively, and lie above the tabs 42. With this structure, the file divider bar 18 slides freely along the file support edge 44 along with the file folders 12 as clearly seen in FIG. 4. The opposed end portions 76 are also formed with pairs of fingers 84 that project forwardly and rearwardly beyond the respective front and rear faces 68, 70 of the file divider bar at generally 90° angles thereto.

The file divider bar 18 has a length I which is longer than the width of each file folder hanging bar 56. The file divider bar 18 also has a width w and a height h which is less than its width. The fingers 84 extend below the bottom edge 66 of the file divider bar 18.

As seen best in FIGS. 4 and 5, the file divider bar 18 is designed to be positioned across the width of the storage cavity 16 and above base wall 36 between a pair of file folders 12. In such a position, the opposed end portions 58 of the file folders 12 and the opposed end portions 76 of the file divider bar 18 are both supported on the file support edge 44 for unrestricted slidable movement thereon. In addition, the forwardly projecting fingers 84 lie outside lateral edges 86 of the rear panel 50 of forwardly disposed file folders 12*a* and normally are spaced slightly below the lowermost portions of hanging rod 56 of the rear panel 50 of file folder 12*a*. The rearwardly projecting fingers 84 lie outside lateral edges 86 of the front panel 48 of rearwardly disposed file folder 12*b* and normally are slightly spaced below the lowermost portions of hanging rod 56 of the front panel 48 of the file folder 12*b*.

Figure 6:
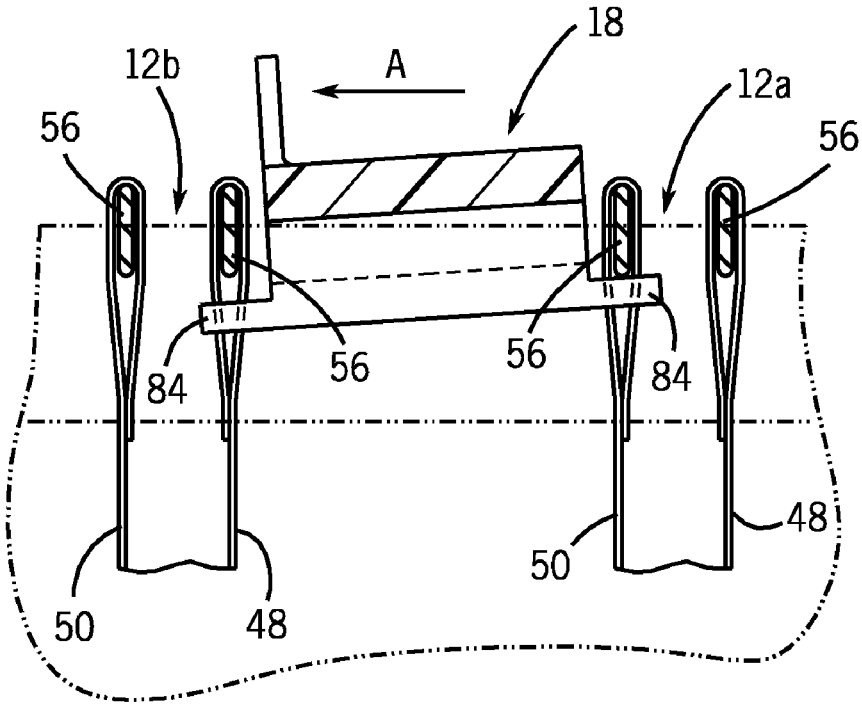
FIGS. 6 and 7 are views like FIG. 5 showing the interaction of the file folders and the file divider bar as the file folders are moved backward and forwards, respectively, within the file organizer.
Figure 7:
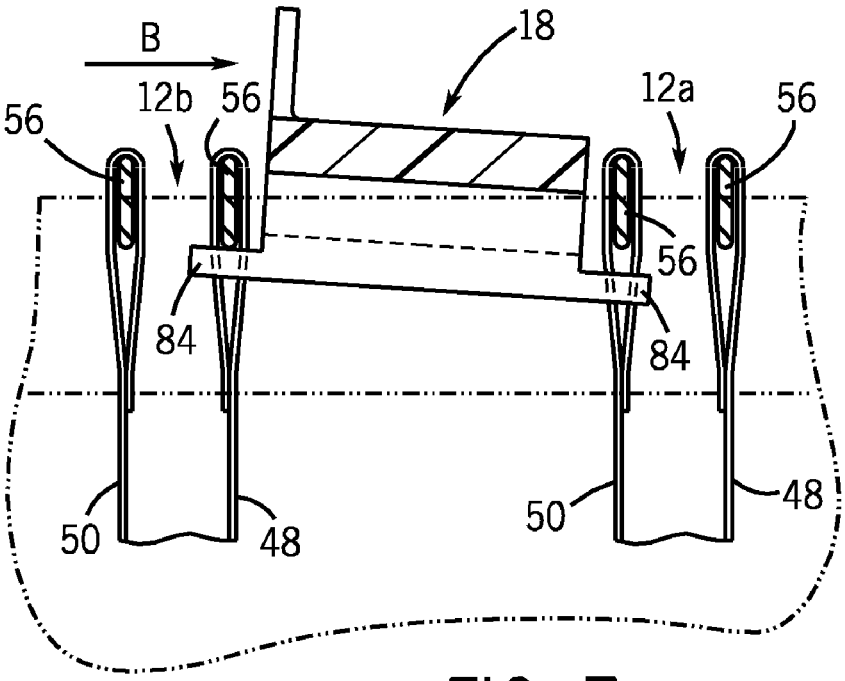

Referring now to FIG. 6, when file folders 12*a*, 12*b* are moved rearwardly within the storage body 14 in the direction of arrow A against other file folders 12, the file divider bar 18 will tilt slightly to the rear. This causes the forwardly projecting fingers 84 to temporarily engage the lowermost portions of the hanging rod 56 of the rear panel 50 of file folder 12*a* so that the file divider bar 18 will not tip and disengage from the file support edge 44. Similarly, with reference to FIG. 7, when the file folders 12*a*, 12*b* are moved forwardly in the direction of arrow B, the file divider bar 18 will tilt slightly to the front. This causes temporary engagement of the rearwardly projecting fingers 84 with the lowermost portions of the hanging rod 56 of the front panel 48 of file folder 12*b* to prevent tipping and disengagement of the file divider bar 18 relative to file support edge 44. Once slidable movement of the file folders 12 has ceased, the file divider bar 18 will assume its normal position shown in FIG. 5.

It can therefore be appreciated that the fingers 84 on the file divider bar 18 conveniently function as stabilizing means engageable with certain of the file folders 12 for maintaining the engagement of the file divider bar 18 upon the file support edge 44 when the file folders 12 and the file divider bar 18 are freely movable back and forth together in the file organizer 10.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

I claim:

1. A file organizer comprising:

a storage body having an outer wall, a file support edge and a bottom wall joined to the outer wall to define an open storage cavity;

at least a pair of file folders for holding various objects, the file folders each extending across a width of the open storage cavity and positioned within the open storage cavity, and having opposed ends slidably supported for unrestricted movement on the file support edge; and at least one file divider extending across and positioned within the open storage cavity between the pair of file folders, the file divider having opposed ends slidably supported for unrestricted movement on the file support edge and provided with stabilizing fingers engageable with the file folders for maintaining the stability of the file divider on the file support edge upon slidable movement together of the file folders and the file divider, wherein the file divider is a bar having a top edge, a bottom edge, a front face and a rear face, the top edge having at least one display tab extending upwardly therefrom.

2. The file organizer of claim 1, wherein a U-shaped channel is joined to the outer wall and includes a base wall, an outer side wall rising generally perpendicularly to the base wall and an inner side wall that rises generally perpendicularly from the base wall and lies parallel to the outer side wall.

3. The file organizer of claim 2, wherein the inner side wall has a top edge defining the file support edge.

4. The file organizer of claim 2, wherein the opposed end portions of the file divider have ears that extend into a receiving cavity formed between the inner and outer side walls.

5. The file organizer of claim 1, wherein the stabilizing fingers are located on the opposed ends of the file divider.

6. The file organizer of claim 5, wherein the stabilizing fingers project from the front and rear faces of the file divider.

7. A file organizer comprising:

a storage body having an outer wall, a file support edge and a bottom wall joined to the outer wall to define an open storage cavity, wherein a U-shaped channel is joined to the outer wall and includes a base wall, an outer side wall rising generally perpendicularly to the base wall and an inner side wall that rises generally perpendicularly from the base wall and lies parallel to the outer side wall;

at least a pair of file folders for holding various objects, the file folders extending across a width of the open storage cavity and positioned within the open storage cavity, and having opposed ends slidably supported for unrestricted movement on the file support edge; and at least one file divider extending across and positioned within the open storage cavity between the pair of file folders, the file divider having opposed ends slidably supported for unrestricted movement on the file support edge and provided with stabilizing fingers engageable with the file folders for maintaining the stability of the file divider on the file support edge upon slidable movement together of the file folders and the file divider, wherein a lowermost surface of the file divider lies above the base wall when the opposed ends thereof are supported on the file support edge.

8. In a file organizer having an outer wall joined to a bottom wall for defining an open storage cavity, the outer wall defining a file support edge for supporting opposed ends of a plurality of freely slidable file folders extending across a width of the file organizer for holding various objects, the improvement comprising:

a file divider bar extending across the width of the file organizer between a pair of adjacently disposed file folders, the file divider bar having opposed ends supported for unrestricted movement upon the file support edge and provided with stabilizing fingers engageable with certain of the file folders for maintaining the stability of the file divider bar as the file folders and the file divider bar are moved back and forth in the file organizer.

9. The improvement of claim 8, wherein the file divider bar includes a top edge provided with a pair of display tabs, a bottom edge, a front face and a rear face.

10. The improvement of claim 9, wherein the fingers project forwardly and perpendicularly beyond the front face and rearwardly and perpendicularly beyond the rear face.

11. The improvement of claim 8, wherein the file folders each include front and rear panels joined at lower ends, each of the front and rear panels having sleeves for receiving hanging rods formed with the opposed ends that are supported on the file support edge.

12. The improvement of claim 11, wherein the fingers are engageable with the opposed ends of certain hanging rods when the file folders and the file divider bar are moved together.

13. The improvement of claim 11, wherein the fingers lie outside lateral edges of the panels and are normally spaced below the hanging rods when the file folders and file divider bar are stationary.

14. The improvement of claim 11, wherein the file divider bar has a length which is greater than the length of the hanging rods.

15. The improvement of claim 8, wherein the file divider bar has a width and a height which is less than the width.

* * * * *